US005204207A

United States Patent [19]

Yamashita et al.

[11] Patent Number: 5,204,207

[45] Date of Patent: Apr. 20, 1993

[54] MAGENTA COLOR LIQUID DEVELOPER FOR ELECTROPHOTOGRAPHY

[75] Inventors: Masahide Yamashita, Numazu; Akihiko Gotoh, Susono, both of Japan

[73] Assignee: Ricoh Company, Ltd., Tokyo, Japan

[21] Appl. No.: 716,990

[22] Filed: Jun. 18, 1991

[30] Foreign Application Priority Data

Jun. 18, 1990 [JP] Japan ..... 2-157547

[51] Int. Cl.[5] ..... G03G 9/12

[52] U.S. Cl. ..... 430/114

[58] Field of Search ..... 430/106, 114

[56] References Cited

U.S. PATENT DOCUMENTS 4,241,159 12/1980 Priem et al. ..... 430/114

4,818,657 4/1989 Kondo et al. ..... 430/114

*Primary Examiner*—John Goodrow

*Attorney, Agent, or Firm*—Oblon, Spivak, McClelland, Maier & Neustadt

[57] ABSTRACT

A magenta color liquid developer for electrophotography composed of a carrier liquid and toner particles dispersed in the carrier liquid, which toner particles contain a resin and two or more pigments including at least one water-insoluble azo pigment and a quinacridone-type pigment.

9 Claims, No Drawings

MAGENTA COLOR LIQUID DEVELOPER FOR ELECTROPHOTOGRAPHY

BACKGROUND OF THE INVENTION

1. Field of the Invention

The present invention relates to a magenta color liquid developer used for image formation in the electrophotographic process, and more particularly, a magenta color liquid developer comprising a toner component which is electrostatically deposited on a latent electrostatic image formed on an electrophotographic photoconductor or on an electrostatic recording medium, thereby developing the latent electrostatic image into a visible toner image.

2. Discussion of Background

To obtain a multicolor image by an electrophotographic method or electrostatic recording method, a latent electrostatic image is first formed on an electrophotographic photoconductor or on a sheet of electrostatic recording paper by the conventional methods. The above-mentioned latent electrostatic image is developed into a visible toner image by color liquid developers in accordance with the subtractive color mixture. Namely, a liquid developer of one primary color is electrostatically deposited on the latent electrostatic image. Another latent electrostatic image is subsequently formed, followed by developing by a liquid developer of another primary color, and the same step as mentioned above is repeated with respect to other colors, so that the latent electrostatic images are developed into a multicolor image.

The liquid developers of primary colors, that is, a cyan liquid developer, a magenta liquid developer and a yellow liquid developer, are separately prepared as follows: The respective pigments are ground and dispersed in a carrier liquid such as an aliphatic hydrocarbon with excellent insulating properties and a low dielectric constant, together with a resin, for example, rosin, linseed oil, soybean oil, modified alkyd resin, styrene-butadiene resin and acrylic resin, and fats and oils.

In multicolor electrophotography, as previously mentioned, a multicolor image can be obtained by subsequently overlapping the development by a plurality of developers of the primary colors. Those liquid color developers are therefore required to have various properties, in particular, required to achieve faithful color reproduction.

Generally, the conventional magenta color liquid developer, one of the liquid developers of primary colors, comprises azo-lake pigments, represented by Carmine 6B. This is because the azo-lake pigments are capable of producing images with satisfactory color tone and high transparency. All the toners comprising the azo-lake pigments, however, have the shortcoming that they readily induce fogging in the background.

When a single color image is formed without overlapping the developers of other colors, the color tone of an image can generally be improved by the addition of a specific dye to a specific pigment in the employed developer. According to the above method for improving the color tone, however, fogging readily takes place as an adverse side effect of the additional dye.

To improve the color tone of a magenta color image, a mixture of a rhodamine-type pigment and a quinacridone-type pigment is contained in a magenta developer as disclosed in Japanese Laid-Open Patent Application 56-75660. By using such a magenta developer, a magenta color image can be obtained with a color tone remarkably close to the ideal magenta color tone.

When the secondary color is produced by overlapping the development of a magenta color and other colors, the color produced by the magenta color developer is occasionally required to assume a red tinged magenta color or a blue tinged magenta color as compared with the above-mentioned ideal magenta color depending upon the overlapping order of colors and the color tone of the other colors. It is therefore difficult to use the aforementioned magenta developer comprising a mixture of pigments for producing the secondary color faithfully by overlapping the development of a plurality of other color developers because the controllable range of color tone, that is, a metric hue-angle, of the above magenta color developer is narrow for use in practice. Furthermore, the aforementioned rhodamine-type pigment contained in the magenta color developer is so poor in light resistance that the tone of the obtained color image changes with time.

To solve the aforementioned fogging problem, a Naphthol AS-type water-insoluble azo pigment, a benzimidazolone-type water-insoluble pigment and a $\beta$-naphthol type water-insoluble pigment are proposed for use as the pigments for the toner composition of a magenta color, as disclosed in Japanese Laid-Open Patent Applications 64-2065, 01-94353 and 01-116565, respectively.

In the case where the magenta liquid developers comprise one of the above-mentioned pigments, images can satisfactorily be produced free from the fogging problem and other abnormality. However, the color tone of such a magenta liquid developer comprising one of the above pigments is determined by the individual color of the pigment, so that it is extremely difficult to change the color tone of a magenta color as desired. Consequently, faithful color reproduction cannot be achieved by superimposing other colors on that kind of magenta color depending upon the selection of liquid developers of other colors.

SUMMARY OF THE INVENTION

Accordingly, an object of the present invention is to provide a magenta color liquid developer for electrophotography, capable of yielding a secondary color with improved color reproduction by overlapping the development of other colors, with the tone of a magenta color being optionally determined in accordance with the overlapping order of colors and the color tone of liquid developers of other colors.

A second object of the present invention is to provide a magenta color liquid developer capable of yielding a clear secondary color, free from the problem of fogging, for which the color tone does not change with time.

The above-mentioned objects of the present invention can be achieved by a magenta color liquid developer for electrophotography comprising a carrier liquid and toner particles dispersed in the above-mentioned carrier liquid, which toner particles comprise a resin and two or more pigments which include at least one water-insoluble azo pigment and one quinacridone-type pigment.

DETAILED DESCRIPTION OF THE PREFERRED EMBODIMENTS

A coloring agent for use in the magenta color liquid developer according to the present invention comprises at least one water-insoluble azo pigment and one quinacridone-type pigment.

Generally, when two kinds of pigments are contained in the magenta color liquid developer and their individual metric hue-angles are too far apart from each other, the produced color tends to become turbid and accordingly the metric chroma thereof is lowered. Therefore, it is preferable that that water-insoluble azo pigment have the property that when a color produced by a liquid developer comprising as a pigment component the water-insoluble azo pigment only, the metric hue-angle of the produced color is in the range of 0° to 40° in terms of the L*a*b* color space, and that the quinacridone-type pigment have the property that when a color produced by a liquid developer comprising as a pigment component the quinacridone-type pigment only, the metric hue-angle of said produced color is in the range of 330° to 360° in terms of the L*a*b* color space.

Examples of the above-mentioned water-insoluble azo pigment include Naphthol AS type water-insoluble azo pigments, benzimidazolone type water-insoluble azo pigments and β-naphthol type water-insoluble azo pigments. Such pigments are preferred because they can contribute to decrease the fogging problem.

In particular, water-insoluble azo pigments having the following formulas (I), (II) and (III) are more preferably employed:

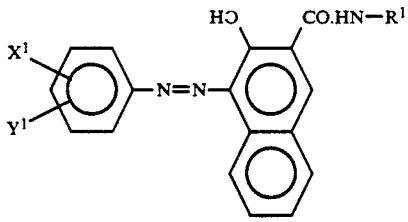

(I)

wherein $R^1$ represents hydrogen or

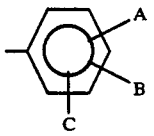

in which A, B and C independently represent —$CH_3$, —Cl, —$NO_2$, —$OCH_3$, —NH.CO.$CH_3$, —$OC_2H_5$ or H;

$X^1$ and $Y^1$ each represent —$CH_3$, —Cl, —$NO_2$, —$OCH_3$, —$SO_2$.NH.$CH_3$, H, —$SO_2$.N$(C_2H_5)_2$ or —CO.NH—

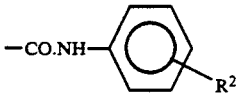

in which $R^2$ represents —$CH_3$, —Cl, —$CONH_2$ or H;

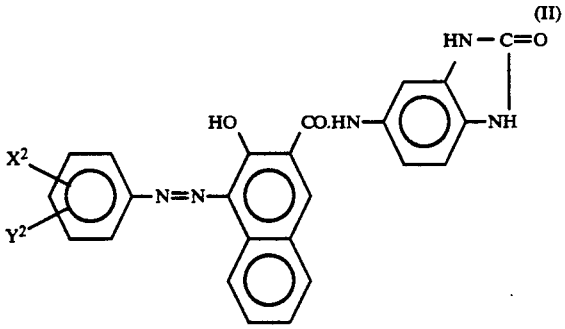

(II)

wherein $X^2$ and $Y^2$ each represent H, —$CH_3$, —$OCH_3$, —$COOCH_3$, —$COOC_4H_9$, —$NO_2$, —$SO_2$.NH.$CH_3$, —Cl or

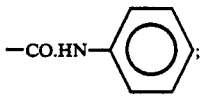

(III)

and

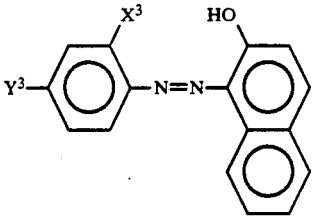

wherein $X^3$ and $Y^3$ each represent H, $NO_2$, Cl or $CH_3$.

Furthermore, it is preferable that the above-mentioned water-insoluble azo pigment (I), (II) or (III) be used together with the quinacridone pigment having formula (IV) in the magenta color liquid developer of the present invention;

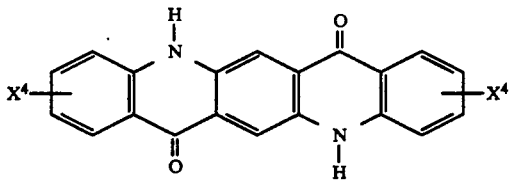

(IV)

wherein $X^4$ represents H, $CH_3$ or Cl.

The reason for this is that either of two kinds of pigments is prevented from being selectively consumed during the development process, and the color produced by the employed magenta color liquid developer is prevented from substantially changing in the course of the running operation. Namely, the change in metric hue-angle of the produced color due to electrophoresis of the selected pigment can be avoided.

Respective examples of the Naphthol AS type water-insoluble azo pigments for use in the present invention are as follows:

(1) C. I. Pigment Red 12
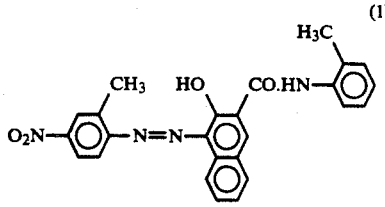
(2) C. I. Pigment Red 14
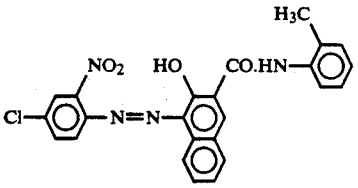
(3) C. I. Pigment Red 18
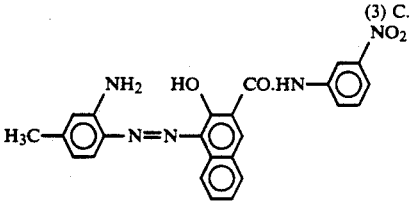
(4) C. I. Pigment Red 23
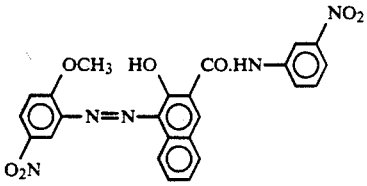
(5) C. I. Pigment Red 31
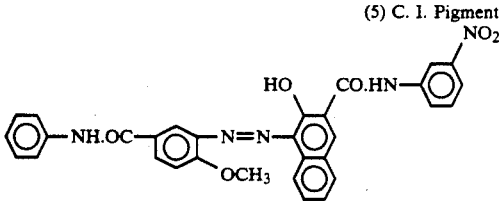
(6) C. I. Pigment Red 114
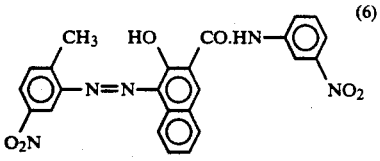
(7) C. I. Pigment Red 150
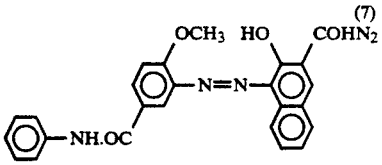
(8) C. I. Pigment Red 170
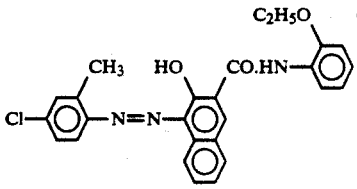
-continued
(9) C. I. Pigment Red 7
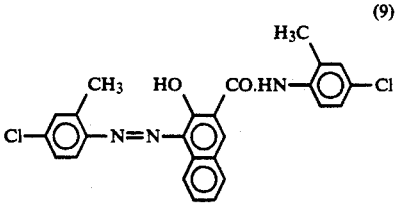
(10) C. I. Pigment Red 8
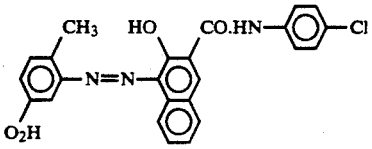
(11) C. I. Pigment Red 9
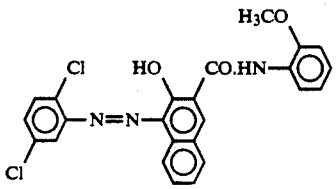
(12) C. I. Pigment Red 10
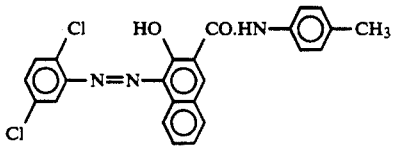
(13) C. I. Pigment Red 15
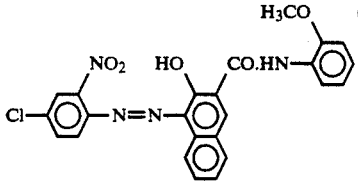
(14) C. I. Pigment Red 17
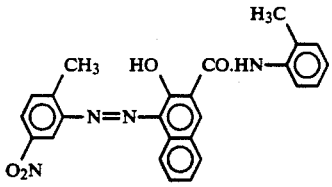
(15) C. I. Pigment Red 22
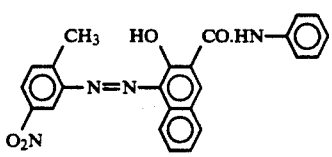
(16) C. I. Pigment Red 112
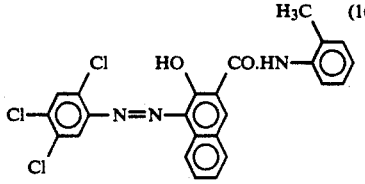

-continued
(17) C. I. Pigment Red 146
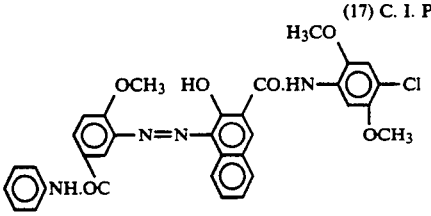
-continued
(18) C. I. Pigment Red 147
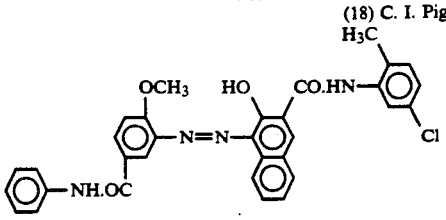
Respective examples of the benzimidazolone type water-insoluble azo pigments for use in the present invention are as follows:
(19) C. I. Pigment Red 171
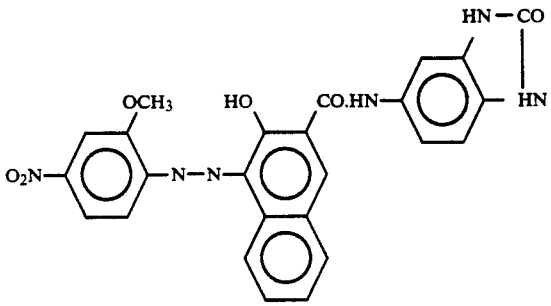
(20) C. I. Pigment Red 175
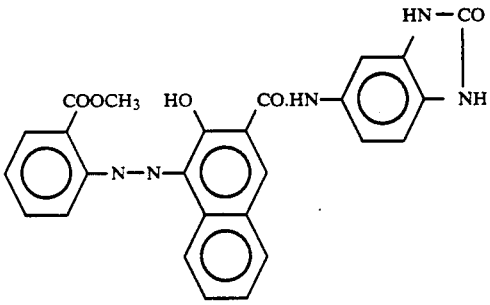
(21) C. I. Pigment Red 176
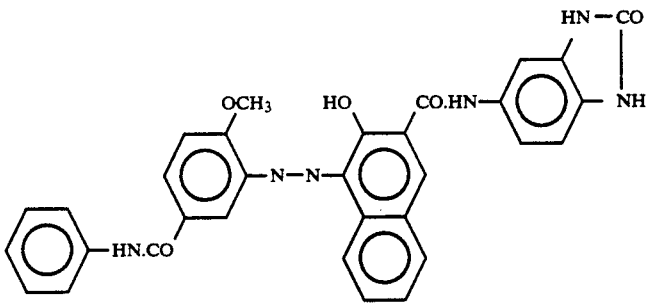
(22) C. I. Pigment Red 185
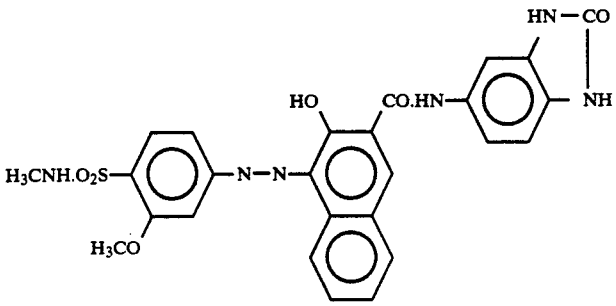

-continued

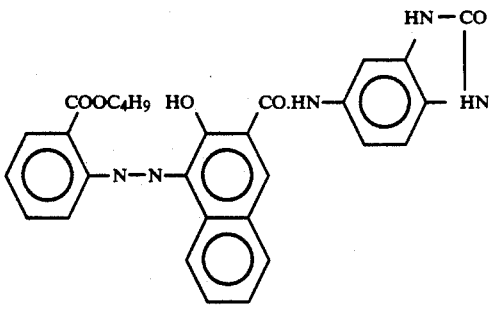

(23) C. I. Pigment Red 208

Respective examples of the β-naphthol type water-insoluble azo pigments for use in the present invention are as follows:

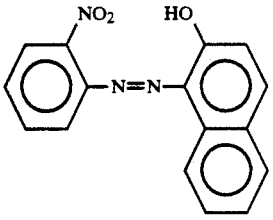

(24) C. I. Pigment Orange 2

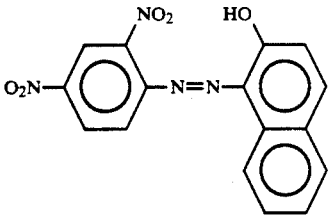

(25) C. I. Pigment Orange 5

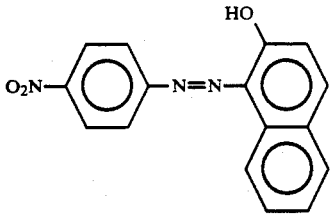

(26) C. I. Pigment Red 1

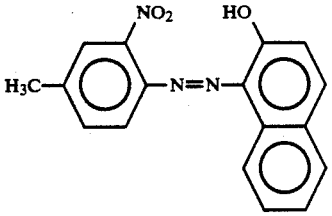

(27) C. I. Pigment Red 3

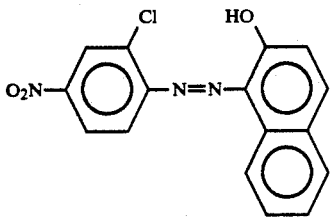

(28) C. I. Pigment Red 4

-continued

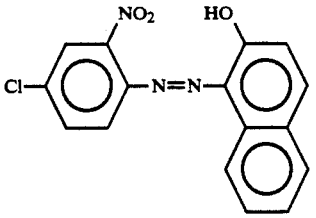

(29) C. I. Pigment Red 6

Respective examples of the quinacridone type pigments for use in the present invention are as follows:

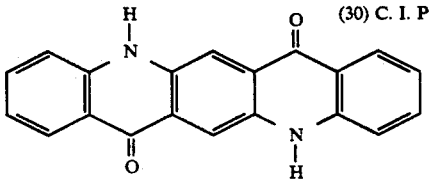

(30) C. I. Pigment Violet 19

(31) C. I. Pigment Red 122

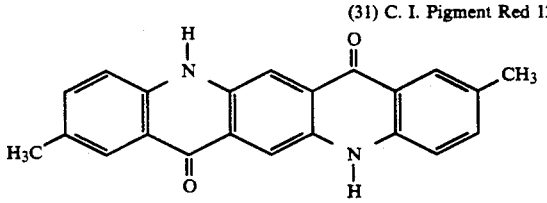

(32) C. I. Pigment Red 209

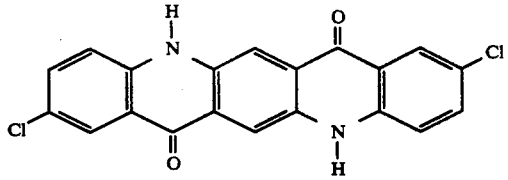

(33) C. I. Pigment Red 202

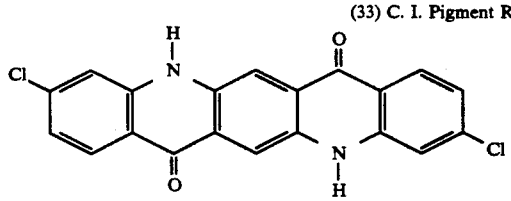

To prepare the magenta color liquid developer according to the present invention, at least one water-insoluble azo pigment and one quinacridone pigment are mixed with an appropriate mixing ratio to prepare a coloring agent or a color material. A mixture of 1 to 10 parts by weight of the above coloring agent, 1 to 50 parts by weight of a binder resin, and 40 to 100 parts by weight of a carrier liquid is kneaded and dispersed in an attritor, ball mill or sand mill to prepare a concentrated liquid developer. The concentrated liquid developer thus prepared may be diluted with a carrier liquid of the same kind as the above, when necessary.

Charge controlling agents such as metallic soaps and metal salts of naphthenic acid, which are generally known, may be added to the above mixture in the course of dispersion or dilution, for the purpose of controlling the charge quantity of the toner to a desired value.

Specific examples of the binder resin for use in the present invention are esters of polyols such as alkyd resin, rosin-modified phenol-formaldehyde resin and hydrogenated rosin; polyacrylic acid ester resin and polymethacrylic acid ester resin; styrene resin; and chlorinated rubber.

In particular, when a mixture of one resin selected from the group (A) and the other resin (B) is used as a binder resin for the magenta color liquid developer of the present invention, the satisfactory results can be obtained.

Resins in Group (A): non-aqueous resins prepared by polymerizing at least one resin selected from the group consisting of a styrene-butadiene resin and a vinyltoluene-butadiene resin, and at least one monomer represented by the following formula (V):

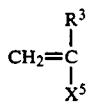

(V)

wherein $R^3$ represents H or $CH_3$; and $X^5$ represents $-COOC_nH_{2n+1}$ or $-OCOC_nH_{2n+1}$, in which n is an integer of 6 to 20.

Resin (B): a copolymer of lauryl methacrylate, glycidyl methacrylate and methyl methacrylate (8:1:1)

To prepare the resin of the group (A), for instance, a styrene-butadiene copolymer is dissolved in a non-aqueous solvent. A monomer having the above formula (V) is added dropwise to the above-prepared solution of styrene-butadiene copolymer to carry out the polymerization reaction at approximately 60° to 120° C. in the presence of a polymerization initiator such as azobisisobutyronitrile (AIBN) or benzoyl peroxide (BPO), which are capable of initiating the polymerization reaction at relatively low temperatures.

The above-mentioned monomer represented by formula (V) can be a solvate after polymerization. Specific examples of the monomer of formula (V) for use in the present invention include lauryl methacrylate, lauryl acrylate, stearyl methacrylate, stearyl acrylate, 2-ethylhexyl methacrylate, 2-ethylhexyl acrylate, dodecyl methacrylate, dodecyl acrylate, hexyl methacrylate, hexyl acrylate, octyl methacrylate, octyl acrylate, cetyl methacrylate, cetyl acrylate, vinyl laurate, vinyl stearate, nonyl methacrylate, nonyl acrylate, decyl methacrylate, decyl acrylate, cyclohexyl methacrylate and cyclohexyl acrylate.

As the polymerization initiator for use in the present invention, phenylazo triphenylmethane, lauroyl peroxide and t-butyl peroxide can be used besides the previously mentioned AIBN and BPO.

For the carrier liquid to prepare the magenta color liquid developer of the present invention, aliphatic hydrocarbons and derivatives thereof are preferable. Specific examples of such carrier liquid include paraffin hydrocarbon or isoparaffin hydrocarbon, for example, commercially available products, "Isopar H", "Isopar G" "Isopar L", "Isopar K" and "No. 6 Solvesso 100" (Trademarks), made by Exxon Chemical Japan Ltd.; ligroin, n-hexane, n-heptane, iso-octane, n-octane, carbon tetrachloride, trichlorotrifluoroethane, and cyclohexane. These can be used alone or in combination.

Furthermore, the pigments other than the above-mentioned water-insoluble azo pigments and quinacridone pigments may be contained in the magenta color liquid developer of the present invention as far as they do not impair the effects of the present invention.

Other features of this invention will become apparent in the course of the following description of exemplary embodiments, which are given for illustration of the invention and are not intended to be limiting thereof.

EXAMPLE 1

A mixture of the following components was dispersed in a ball mill for 24 hours to prepare a concentrated magenta color liquid developer.

30 parts by weight of the concentrated magenta color liquid developer was diluted with 1 l of a commercially available aliphatic hydrocarbon "Isopar H" (Trademark), made by Exxon Chemical Japan Ltd., so that a magenta color liquid developer according to the present invention was obtained.

| | Parts by Weight |
|---|---|
| A mixture of Naphthol AS-type water-insoluble azo pigment (7) [C.I. Pigment Red 150] and quinacridone type pigment (31) [C.I. Pigment Red 122] (mixing ratio = 80:20) | 5 |
| Lauryl methacrylate/glycidyl methacrylate/methyl methacrylate copolymer (8:1:1) (Dispersion of "Isopar H" with a solid content of 30%) | 30 |
| Styrene butadiene/2-ethylhexyl methacrylate copolymer (1:2) (Dispersion of "Isopar H" with a solid content of 40%) | 20 |
| Aliphatic hydrocarbon "Isopar H" (Trademark), made by Exxon Chemical Japan Ltd. | 44 |
| Calcium alkylsalicylate | 1 |

EXAMPLES 2 TO 4

The procedure for preparation of the magenta color liquid developer used in Example 1 was repeated except that the mixing ratio of the Naphthol AS-type water-insoluble azo pigment (7) [C.I. Pigment Red 150] and the quinacridone type pigment (31) [C.I. Pigment Red 122] was respectively changed as shown in Table 1, so that magenta color liquid developers according to the present invention were separately obtained.

COMPARATIVE EXAMPLES 1 AND 2

The procedure for preparation of the magenta color liquid developer used in Example 1 was repeated except that the mixing ratio of the Naphthol AS-type water-insoluble azo pigment (7) [C.I. Pigment Red 150] and the quinacridone type pigment (31) [C.I. Pigment Red 122] was respectively changed as shown in Table 1, so that comparative magenta color liquid developers were separately obtained.

TABLE 1

| | Naphthol-AS type Azo Pigment/ Quinacridone Pigment (mixing ratio) |
|---|---|
| Example 1 | 80:20 |
| Example 2 | 60:40 |
| Example 3 | 40:60 |
| Example 4 | 20:80 |
| Comparative Example 1 | 100:0 |
| Comparative Example 2 | 0:100 |

EXAMPLES 5 TO 8

The procedure for preparation of the magenta color liquid developers in Examples 1 to 4 was respectively repeated except that the Naphthol AS-type water-insoluble azo pigment (7) [C.I. Pigment Red 150] was changed to Naphthol AS-type water-insoluble azo pigment (5) [C.I. Pigment Red 31] and the quinacridone type pigment (31) [C.I. Pigment Red 122] was changed to quinacridone type pigment (32) [C.I. Pigment Red 209], so that magenta color liquid developers according to the present invention were separately obtained.

EXAMPLES 9 TO 12

The procedure for preparation of the magenta color liquid developers in Examples 1 to 4 was respectively repeated except that the Naphthol AS-type water-insoluble azo pigment (7) [C.I. Pigment Red 150] was changed to benzimidazolone type water-insoluble azo pigment (21) [C.I. Pigment Red 176], so that magenta color liquid developers according to the present invention were separately obtained.

EXAMPLES 13 TO 16

The procedure for preparation of the magenta color liquid developers in Examples 1 to 4 was respectively repeated except that the Naphthol AS-type water-insoluble azo pigment (7) [C.I. Pigment Red 150] was changed to benzimidazolone type water-insoluble azo pigment (22) [C.I. Pigment Red 185] and the quinacridone type pigment (31) [C.I. Pigment Red 122] was changed to quinacridone type pigment (32) [C.I. Pigment Red 209], so that magenta color liquid developers according to the present invention were separately obtained.

EXAMPLES 17 TO 20

The procedure for preparation of the magenta color liquid developers in Examples 1 TO 4 was respectively repeated except that the Naphthol AS-type water-insoluble azo pigment (7) [C.I. Pigment Red 150] was changed to $\beta$-naphthol type water-insoluble azo pigment (25) [C.I. Pigment Orange 5], so that magenta color liquid developers according to the present invention were separately obtained.

EXAMPLES 21 TO 24

The procedure for preparation of the magenta color liquid developers in Examples 1 TO 4 was respectively repeated except that the Naphthol AS-type water-insoluble azo pigment (7) [C.I. Pigment Red 150] was changed to $\beta$-naphthol type water-insoluble azo pigment (27) [C.I. Pigment Red 3] and the quinacridone type pigment (31) [C.I. Pigment Red 122] was changed to quinacridone type pigment (32) [C.I. Pigment Red 209], so that magenta color liquid developers according to the present invention were separately obtained.

EXAMPLES 25 TO 28

The procedure for preparation of the magenta color liquid developers in Examples 1 to 4 was respectively repeated except that the Naphthol AS-type water-insoluble azo pigment (7) [C.I. Pigment Red 150] was changed to a water-insoluble azo pigment having the following formula (VI) [C.I. Pigment Red 16], so that magenta color liquid developers according to the present invention were separately obtained.

(VI)

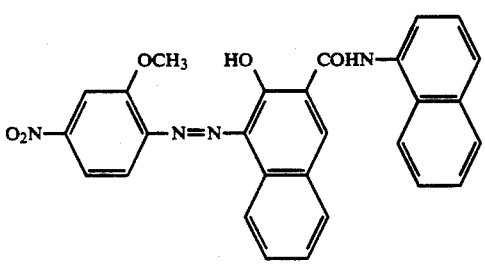

EXAMPLES 29 TO 32

The procedure for preparation of the magenta color liquid developers in Examples 1 to 4 was respectively repeated except that the Naphthol AS-type water-insoluble azo pigment (7) [C.I. Pigment Red 150] was changed to a water-insoluble azo pigment having the following formula (VII) [C.I. Pigment Red 40] and the quinacridone type pigment (31) [C.I. Pigment Red 122] was changed to quinacridone type pigment (32) [C.I. Pigment Red 209], so that magenta color liquid developers according to the present invention were separately obtained.

(VII)

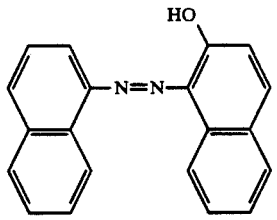

Each magenta color liquid developer obtained in the above Examples 1 to 32 and Comparative Examples 1 and 2 was placed in a commercially available electrostatic color printing plotter "CE-3436" (Trademark), made by Versatec, Inc., and an image development test was conducted.

The results are given in Table 2.

TABLE 2

| | Color Tone of a Single Color Produced by Magenta Liquid Developer (*) | Fogging (**) |
|---|---|---|
| Ex. 1 | 11.36 | 0.012 |
| Ex. 2 | 4.77 | 0.010 |
| Ex. 3 | −1.44 | 0.010 |
| Ex. 4 | −7.08 | 0.010 |
| Comp. Ex. 1 | 18.98 | 0.010 |
| Comp. Ex. 2 | −12.68 | 0.014 |
| Ex. 5 | 13.41 | 0.010 |
| Ex. 6 | 6.77 | 0.012 |

TABLE 2-continued

| | Color Tone of a Single Color Produced by Magenta Liquid Developer (*) | Fogging (**) |
|---|---|---|
| Ex. 7 | −0.08 | 0.010 |
| Ex. 8 | −6.45 | 0.012 |
| Ex. 9 | 13.52 | 0.010 |
| Ex. 10 | 7.00 | 0.010 |
| Ex. 11 | 0.59 | 0.010 |
| Ex. 12 | −5.88 | 0.012 |
| Ex. 13 | 12.63 | 0.012 |
| Ex. 14 | 6.35 | 0.012 |
| Ex. 15 | −0.05 | 0.012 |
| Ex. 16 | −6.57 | 0.012 |
| Ex. 17 | 38.50 | 0.010 |
| Ex. 18 | 26.32 | 0.010 |
| Ex. 19 | 13.24 | 0.010 |
| Ex. 20 | 0.04 | 0.012 |
| Ex. 21 | 32.02 | 0.012 |
| Ex. 22 | 20.77 | 0.010 |
| Ex. 23 | 9.44 | 0.010 |
| Ex. 24 | −1.76 | 0.012 |
| Ex. 25 | 6.25 | 0.012 |
| Ex. 26 | 1.48 | 0.010 |
| Ex. 27 | −3.20 | 0.010 |
| Ex. 28 | −7.85 | 0.010 |
| Ex. 29 | 7.60 | 0.014 |
| Ex. 30 | 2.65 | 0.012 |
| Ex. 31 | −2.38 | 0.012 |
| Ex. 32 | −7.69 | 0.010 |

(*) The color difference of the produced image (L*, a* and b* values) was measured by a commercially available differential colorimeter "CR-121" (Trademark), made by Minolta Camera Co., Ltd., and the metric hue-angle (H) was calculated in accordance with the formula of $H = \tan^{-1}(b/a)$. The color tone was expressed by the thus obtained metric hue-angle (H°).
In the case where the metric hue-angle of the produced color exceeded 180°, the metric hue-angle was obtained by subtracting 360 therefrom. As the value of the metric hue-angle becomes larger, the color tone inclines to a red color.
(**) The fogging was expressed by the value obtained by subtracting the density of the background before printing from the density of the background after printing, which were measured by a commercially available reflection-type densitometer "RD-914" (Trademark), made by Mcbeth Co., Ltd.

As a result, images were produced with such a color tone as optionally determined, without the problem of fogging when images were developed by the magenta color liquid developers obtained in Examples 1 to 32.

In particular, the magenta liquid developers obtained in Examples 2 and 3 produced images with a desired color tone (a metric hue-angle of within ±5°) as a magenta color produced by an electrophotographic liquid developer, so that color reproduction of a magenta color was excellent.

In contrast to this, when the comparative magenta color liquid developer obtained in Comparative Example 1 was subjected to the above-mentioned image development test, although the fogging did not occur, the color tone of the produced images excessively inclined to a yellow color, so that color reproduction was not satisfactorily achieved.

In addition, when the comparative magenta color liquid developer obtained in Comparative Example 2 was subjected to the above-mentioned image development test, although the fogging did not occur, the color tone of the produced images excessively inclined to a blue color, so that color reproduction was not satisfactorily achieved, either.

Furthermore, in order to evaluate the color reproduction of a red color, images were developed by using each of the magenta color liquid developers obtained in Examples 1 to 4 and Comparative Examples 1 and 2, and then, a yellow color was superimposed thereon by using a yellow color liquid developer which is capable of producing a yellow color with a metric hue-angle of 96.82°.

The results are given in Table 3.

TABLE 3

| | Color Tone of Image Obtained by Overlapping Yellow Liquid Developer (*) |
|---|---|
| Ex. 1 | 35.38 |
| Ex. 2 | 34.16 |
| Ex. 3 | 33.14 |
| Ex. 4 | 29.03 |
| Comp. Ex. 1 | 36.56 |
| Comp. Ex. 2 | 22.11 |

(*) The color tone was expressed by the metric hue-angle (H°) in the same manner as in the above.

As a result of the evaluation of a red color reproduction by superimposing a yellow color on a magenta color, the metric hue-angle of the produced color was gradationally changed depending on the mixing ratio of the two kinds of pigments in the case where the magenta color liquid developers obtained in Examples 1 to 4 were used. Namely, the reproduction of a red color can be optionally controlled depending on the mixing ratio of the two kinds of pigments.

In particular, when an image was developed by the magenta color liquid developer obtained in Example 3, followed by superimposing the yellow color liquid developer thereon, the tone of the produced color image was remarkably close to an ideal red color (with a metric hue-angle of 33°), and excellent color reproduction by overlapping the other color was observed.

In contrast to this, when an image was developed by the comparative magenta color liquid developer obtained in Comparative Example 1, followed by superimposing the yellow color liquid developer thereon, the produced image assumed a yellow-tinged red color. In addition, in the case of the comparative magenta liquid developer obtained in Comparative Example 2, the produced image assumed a blue-tinged red color. The color reproduction by overlapping the other color was not satisfactory in both cases.

Furthermore, the aforementioned electrostatic printing plotter was continued to run, replenished with the magenta color liquid developer obtained in Example 3 or that in Comparative Example 1. The tone of a magenta color produced by the above developers was deviated to the same extent during the running operation. It was confirmed that electrophoresis of the selected one pigment did not occur. This fact can be known from the straight change of the metric hue-angle depending upon the mixing ratio of the two kinds of pigments contained in the developers obtained in Examples 1 to 24.

A preservability test was carried out by storing the magenta color liquid developers obtained in Examples 1 to 32 for 3 months and developing images thereby.

As a result, any abnormality was observed in the produced images.

In addition, a light-resistance test was conducted by developing images with the magenta color liquid developers obtained in Examples 1 to 4 and exposing the developed images to the light for 48 hours using a fadeometer.

As a result, there was no deterioration in the developed images. The color tone obtained after the light-resistance test was almost the same as that obtained before the test. There was no problem of the change in color tone due to the deterioration of one pigment contained in the developer.

As previously mentioned, the tone of a magenta color can be optionally determined when the magenta color liquid developers according to the present invention are used. At the same time, the problem of fogging is not induced.

When the magenta color liquid developers of the present invention are employed, the metric hue-angle of the produced color can be controlled within a proper range by changing the mixing ratio of the two kinds of pigments contained in the developer.

In addition, the color reproduction can be improved when a color image is formed by overlapping other colors.

Furthermore, the image developed by the magenta liquid developer of the present invention is superior in the light-resistance, and the color tone of the image scarcely change with the elapse of time.

The magenta color liquid developers according to the present invention can be applied to the electrophotographic process and used as a color liquid developer to obtain a desired red color image.

What is claimed is:

1. A magneta color liquid developer for use in electrophotography comprising a carrier liquid and toner particles dispersed in said carrier liquid, which toner particles comprise a resin and at least two pigments, one being a water-insoluble azo pigment and the other being a quinacridone-type pigment, wherein said water-insoluble azo pigment has the property that when a color produced by a liquid developer comprising as a pigment component said water-soluble azo pigment only, the metric hue-angle of said produced color is in the range of 0° to 40° in terms of the L*a*b* color space, and said quinacridone-type pigment has the property that when a color produced by a liquid developer comprising as a pigment component said quinacridone-type pigment only, the metric hue-angle of said produced color is in the range of 330° to 360° in terms of the L*a*b* color space.

2. The magenta color liquid developer as claimed in claim 1, wherein said water-insoluble azo pigment is selected from the group consisting of Naphthol AS type water-insoluble azo pigments, benzimidazolone type water-insoluble azo pigments and β-naphthol type water-insoluble azo pigments.

3. The magenta color liquid developer as claimed in claim 2, wherein said water-insoluble azo pigment is selected from the group consisting of pigments having formulas (I), (II) and (III):

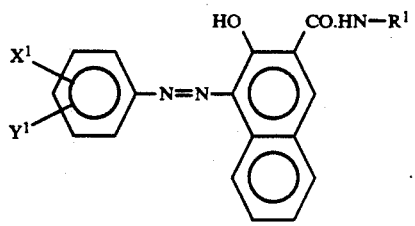

(I)

wherein $R^1$ represents hydrogen or

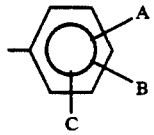

in which A, B and C independently represent $-CH_3$, $-Cl$, $-NO_2$, $-OCH_3$, $-NH.CO.CH_3$, $-OC_2H_5$ or H;

$X^1$ and $Y^1$ each represent $-CH_3$, $-Cl$, $-NO_2$, $-OCH_3$, $-SO_2.NH.CH_3$, H, $-SO_2.N(C_2H_5)_2$ or

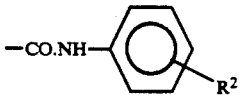

in which $R^2$ represents $-CH_3$, $-Cl$, $-CONH_2$ or H;

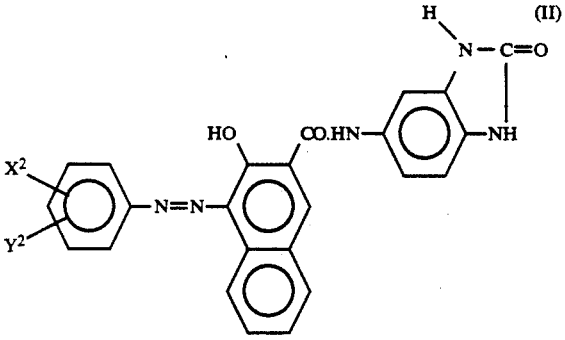

(II)

wherein $X^2$ and $Y^2$ each represent H, $-CH_3$, $-OCH_3$, $-COOCH_3$, $-COOC_4H_9$, $-NO_2$, $-SO_2.NH.CH_3$, $-Cl$ or

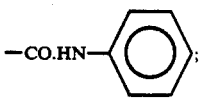

(III)

and

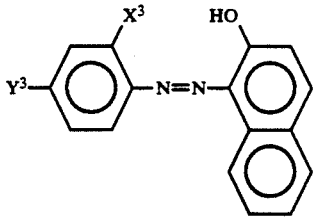

wherein $X^3$ and $Y^3$ each represent H, $NO_2$, Cl or $CH_3$.

4. The magenta color liquid developer as claimed in claim 1, wherein said quinacridone pigment is selected from the group consisting of pigments having formula (IV):

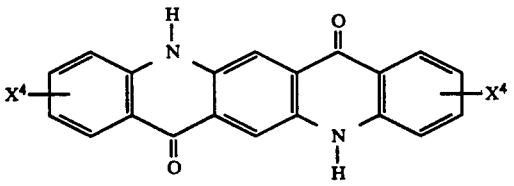

(IV)

wherein $X^4$ represents H, $CH_3$ or Cl.

5. The magenta color liquid developer as claimed in claim 1, wherein the mixing ratio of said pigments to said binder resin is (1-10):(1-50) in terms of parts by weight.

6. The magenta color liquid developer as claimed in claim 1, further comprising a charge controlling agent.

7. The magenta color liquid developer as claimed in claim 1, wherein said binder resin is selected from the group consisting of alkyd resin, rosin-modified phenol-formaldehyde resin, hydrogenated rosin, polyacrylic acid ester resin, polymethacrylic acid ester resin, styrene resin and chlorinated rubber.

8. The magenta color liquid developer as claimed in claim 7, wherein said binder resin is a mixture of one resin selected from the group consisting of non-aqueous resins prepared by polymerizing at least one resin selected from the group consisting of a styrene-butadiene resin and a vinyltoluene-butadiene resin, and at least one monomer represented by formula (V):

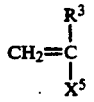

(V)

wherein $R^3$ represents H or $CH_3$; and $X^5$ represents $-COOC_nH_{2n+1}$ or $-OCOC_nH_{2n+1}$, in which n is an integer of 6 to 20;

and the other resin selected from the group consisting of copolymers of lauryl methacrylate, glycidyl methacrylate and methyl methacrylate with a mixing ratio of 8:1:1.

9. The magenta color liquid developer as claimed in claim 1, wherein said carrier liquid is selected from the group consisting of paraffin hydrocarbon, isoparaffin hydrocarbon, ligroin, n-hexane, n-heptane, iso-octane, n-octane, carbon tetrachloride, trichlorotrifluoroethane, and cyclohexane.

* * * * *

UNITED STATES PATENT AND TRADEMARK OFFICE

CERTIFICATE OF CORRECTION

PATENT NO. : 5,204,207

DATED : April 20, 1993

INVENTOR(S) : Masahide Yamashita et al

It is certified that error appears in the above-indentified patent and that said Letters Patent is hereby corrected as shown below:

Column 5, line 54, "$COHN_2$" should read --$CONH_2$--.

Column 9, line 5, "HN" should read --NH--.

Signed and Sealed this

Eighteenth Day of October, 1994

*Attest:*

*Attesting Officer*

BRUCE LEHMAN

*Commissioner of Patents and Trademarks*